US008721993B2

(12) United States Patent
Lockwood et al.

(10) Patent No.: US 8,721,993 B2
(45) Date of Patent: May 13, 2014

(54) MAGNETIC CLAMPS FOR LABORATORY SHAKERS

(75) Inventors: Mark D. Lockwood, Dubuque, IA (US); Mark G. Loeffelholz, Dubuque, IA (US)

(73) Assignee: LabStrong Corp., Dubuque, IA (US)

( * ) Notice: Subject to any disclaimer, the term of this patent is extended or adjusted under 35 U.S.C. 154(b) by 0 days.

(21) Appl. No.: 13/419,515

(22) Filed: Mar. 14, 2012

(65) Prior Publication Data

US 2012/0237416 A1 Sep. 20, 2012

Related U.S. Application Data

(60) Provisional application No. 61/452,250, filed on Mar. 14, 2011.

(51) Int. Cl.
*B01L 9/04* (2006.01)

(52) U.S. Cl.
USPC ..... 422/561; 366/214

(58) Field of Classification Search
USPC ..... 422/208, 214, 210, 211, 561; 366/209, 366/208, 214, 210, 211
See application file for complete search history.

(56) References Cited

U.S. PATENT DOCUMENTS

| | | | | |
|---|---|---|---|---|
| 5,593,228 | A * | 1/1997 | Tannenbaum | 366/209 |
| 7,059,762 | B2 | 6/2006 | Yi | |
| 2007/0257021 | A1* | 11/2007 | Lockwood et al. | 219/443.1 |
| 2011/0309217 | A1 | 12/2011 | Demsia | |

OTHER PUBLICATIONS

2L Flask Clamp, 207704, Lab Safety Supply, http://www.labsafety.com/21-flask-clamp_s_207704, website visited Mar. 8, 2012.
125/150ml Flask Clamp, 20770, Lab Safety Supply, http://www.labsafety.com, website visited Mar. 8, 2012.
Dedicated 500ml Flask Platform for Incu-Shaker Mini, Spectrum Scientifics, http://www.spectrum-scientifics.comn/cgi-bin/commercie.cgi?, website visited Mar. 8, 2012.
Incu-Shaker Mini, The Lab Depot, Inc., http://www.labdepotinc.com/Product_Details, website visited Mar. 8, 2012.

* cited by examiner

*Primary Examiner* — Natalia Levkovich
(74) *Attorney, Agent, or Firm* — Andrus Intellectual Property Law, LLP

(57) ABSTRACT

A clamp for an Erlenmeyer flask or other laboratory containers or racks uses nickel-coated, rare earth magnets to secure the clamp to a platform for a laboratory shaker. The base of the clamp has downwardly extending positioning bosses that seat in holes or indentations on the shaker platform to prevent horizontal sliding of the clamp when the shaker is in use. A removable and replaceable, elastomeric cover for the base of the flask clamp provides cushioning and prevents spinning of the flask when the shaker is in use.

27 Claims, 8 Drawing Sheets

MAGNETIC CLAMPS FOR LABORATORY SHAKERS

FIELD OF THE INVENTION

The invention pertains to laboratory products and in particular to clamps for laboratory shakers.

BACKGROUND OF THE INVENTION

Shakers are widely used in laboratories to stir liquids held in beakers, flasks or test tubes. The shaker has a platform that oscillates horizontally when the shaker is operating. A shaker platform will normally include an array of threaded holes to enable attachment of clamps to the platform with screws. Metal flask clamps for Erlenmeyer flasks typically include a pair of intersecting bands that extend horizontally to form a base and bend upward to extend above the hip of the flask and along the tapered wall of the flask. Normally, a spring coil is attached around the ends of the bent bands. The flask is inserted into the clamp by expanding the spring coil and the bands outwardly by pressing the base of the flask into the opening created by the spring coil. One of the issues with metal clamps of that flasks tend to spin within the clamps when the shaker operates. The spinning can cause marring if the flask is made of glass, and in fact can cause substantial damage if the flask is made of plastic. Another issue is that metal springs require extreme forces to insert or remove the flask, and there is the danger of flask breakage. In addition, the metal springs tend to deform and loosen after repeated use and the flasks tend to rattle loosely inside the metal flask clamp creating significant noise pollution in the workspace. If the flask contains a large volume of fluid significant torque is generated which can cause the flask to spin excessively within the clamp especially if the metal springs are loose. Plastic clamps have been offered in the industry, but have not been widely accepted primarily because they do not conform well to the flask.

In addition, it is inconvenient for laboratory workers to detach and replace the clamps because the clamps are screwed to the shaker platform. For example, the laboratory worker must first retrieve a screw driver with a correct head and then physically screw and unscrew the clamps onto the platform. It is relatively common for laboratory workers to lose the screws, or to strip the threads on the screw or on the platform or strip the screw heads. As such, reconfiguring the clamp arrangement on the platform can be quite time consuming. Since most shaker platforms are removable, most laboratory workers simply remove the shaker platforms with the flask clamps attached for cleaning, autoclaving, or even sometimes to change the size of clamps attached to the platform. It is typical for a laboratory to have several shaker platforms with different flask clamps screwed to the platform. Storage can be an issue because space in the laboratory is often limited.

Clamps for other laboratory containers are also known in the prior art. For example, clamps for test tubes or test tube racks can be mounted onto a laboratory shaker platform as well.

SUMMARY OF THE INVENTION

In one aspect, the invention pertains to a flask clamp that uses permanent magnets to attach the flask clamp to the shaker platform thus allowing the flask clamp to be easily removed from the platform without the use of tools. The clamp simplifies installation, as well as cleaning, autoclaving and configuration changes. Moreover, the invention allows the user to use one platform in the laboratory, and thus avoids the hassle of removing and storing several platforms with flask clamps screwed thereto.

In its preferred form, the clamp has a generally circular base constructed of two generally circular plates. One or more permanent magnets are attached and exposed below the base, preferably three nickel-coated, rare earth magnets equally spaced around the periphery of the base. The top circular base plate is desirably magnetic, e.g. non-magnetized stainless steel. The bottom circular plate includes holes through which the rare earth magnets extend. The bottom base plate with the magnet holes is desirably made of a non-magnetic material, such as non-magnetic stainless steel. The nickel-coated, rare earth magnets are preferably flat magnets, and the flat bottom surface of the magnets (as well as a magnetic base plate) are magnetically attracted to the shaker platform, which is preferably made of magnetic, non-magnetized stainless steel. The nickel coating helps to protect the rare earth magnets from corrosion and chipping and also provides an improved surface for adhesion of the magnets to the clamp base. In addition, the use of a nickel coating does not compromise the viability of biological cells in the laboratory, as would for example a zinc coating.

The base of the flask clamp also includes downwardly extending positioning bosses, for example three positioning bosses made of engineered thermal plastic such as polyoxymethylene. The downwardly extending bosses are sized and configured to fit into clamp positioning holes or indentations on the shaker platform when the flask clamp is positioned on the shaker platform with the magnets exerting magnetic pressure to hold the flask clamp on the shaker platform. The positioning bosses prevent the flask clamp from sliding on the surface of the shaker platform while the shaker is in use. The clamp positioning holes or indentations on the shaker platform are preferably non-threaded such that the positioning bosses can be easily set in the holes or indentations without a tool.

The flask clamp also includes a flask holding mechanism attached to the clamp base. The flask holding mechanism provides one or more inwardly biased holding surfaces located above the hip line on the Erlenmeyer flask thus exerting pressure along the tapered portion of the sidewall of an Erlenmeyer flask. Preferably, the holding mechanism consists of three bent wire or sheet metal spring fingers that are connected to the base and extend upward to hold a contoured roller or roller set. The three contoured rollers or roller sets provide equally spaced holding surfaces and are shaped to fit the flask profile so as to reduce point contact and surface stress. The rollers are made of plastic and/or have a soft elastomeric (e.g. silicone) sleeve stretched over the rollers to eliminate metal contact with the flask. The use of three spring fingers and rollers or roller sets significantly reduces the force required to insert and remove flask. The resilience of the spring fingers provides inward biasing of the rollers against the tapered portion of the sidewall of an Erlenmeyer flask placed in the clamp. The normal forces exerted by the rollers on the Erlenmeyer flask include not only an inward radial holding force component but also a downward force component. The soft elastomeric sleeves on the rollers helps prevent spinning of the flask and is especially helpful for large flasks that tend to generate significant spinning torque when liquid inside the flask is stirred.

The clamp base also preferably includes a removable, elastomeric cover that provides a frictional surface for the base of the flask. The frictional forces on bottom surface of the flask prevent the flask from spinning when the shaker is in use. The downward component of the normal force exerted on an Erlenmeyer flask by the clamp rollers facilitates the effect of the frictional surface. The elastomeric cover also preferably includes an overlapping lip that extends over the peripheral edge of the base, and in some places underneath the base. The lip provides a seal against the shaker platform in case of a spill inasmuch as magnetic pressure pulls the base of the flask clamp and the elastomeric lips against the shaker platform. It has been found that the above described configuration including the elastomeric, replaceable cover and the contoured plastic rollers (or roller sets) provide a desired amount of cushioning and significantly quieter operation of the shaker. The three finger configuration also significantly reduces the required insertion and removal forces without compromising security of the flask in the clamp while the shaker is operating. Ease of flask removal is especially helpful when the contents of the flask generate heat and the flask is hot to the touch. It also reduces the likelihood of a spill from a sudden release and enables insertion and removal with one hand.

For stability purposes, it has been found desirable to equally space the magnets from one another and also locate the magnets near the periphery of the clamp base. Placing the magnets near the periphery of the clamp base maximizes flux density of the magnetic field near the periphery of the base, as opposed to using a single magnet centered under the flask. While the flask holding mechanism with spring fingers and rollers (or roller sets) significantly reduces the amount of force necessary to remove a flask, it is still desirable to locate the magnets near the periphery of the base in order to avoid tipping when the flask is removed or during vigorous shaking motion.

The use of multiple rare earth magnets allows for the polar alignment of the magnets to be optimized in order to increase the magnetic flux density between the flask clamp base and the platform. For example, staggered polar alignment may increase magnetic flux density and overall attraction of the clamp to the shaker platform. The rare earth magnets are preferably adhered to the top base plate which is made of magnetic stainless steel. The use of the magnetic stainless steel top base plate reduces the magnetic field in the flask and additionally helps to focus magnetic flux density (magnetic attraction) between the base plate and the shaker platform. In an alternative embodiment, the rare earth magnets can be manufactured with a step peripheral shoulder, and instead of using adhesive to attach the magnets to the top base plate, the magnets are attached to the base by mechanically capturing the shoulders on the magnets between the plates in the base assembly.

The clamp base as described above can be used to hold other types of laboratory containers or racks besides an Erlenmeyer flask. For example, one embodiment of the invention involves the use of a clamp base having one or more permanent magnets and at least two positioning bosses as a support for a test tube rack holder. Since test tubes racks are typically rectangular in shape, the holder and clamp base are also desirably rectangular in shape. In addition to the other features described above, stabilizing feet are desirably used at the corners of the rectangular base in order to improve stability without requiring the use of additional magnets. Stabilizing feet can of course be used in connection with circular clamp bases if deemed necessary.

In another embodiment of the invention, the flat magnets extend downward from the base farther than in the previous embodiments, and serve the dual purpose of functioning as the positioning bosses as well. In the embodiment, the shaker platform must include position indentations and not positioning holes.

In yet another embodiment of the invention, the permanent magnets are not located on the clamp base, but rather are located underneath the shaker platform. In this embodiment, the platform should be made of non-magnetic material such as magnetic stainless steel. In addition, the base of the clamp should be made from a magnetic, non-magnetized material such as non-magnetized stainless steel. This approach has the advantage of eliminating the permanents magnets from the construction of the clamp base.

Other features and advantages of the invention may be apparent to those of ordinary skill in the art upon reviewing the following drawings and description thereof.

DETAILED DESCRIPTION

Figure 1:
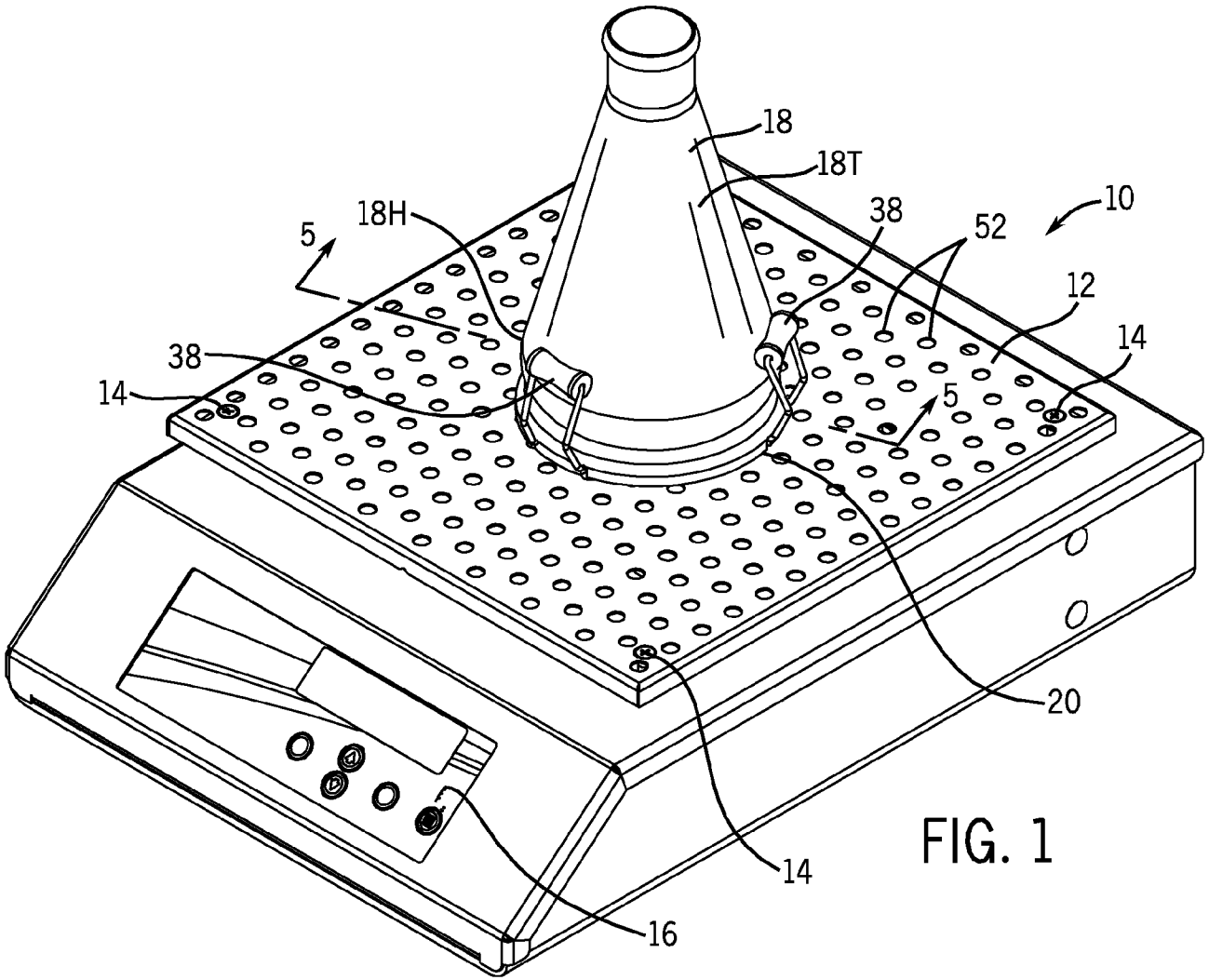
FIG. 1 is a perspective view showing a flask clamp constructed in accordance with an exemplary first embodiment of the invention holding an Erlenmeyer flask on a laboratory shaker.

FIG. 1 shows a laboratory shaker 10 having a platform 12 containing an array of non-threaded positioning holes 52. The platform 12 is attached to the shaker 10 using, e.g. screws 14. The shaker 10 contains a motor and drive system that oscillates the platform 12 horizontally as is known in the art. The shaker 10 includes a user control panel 16 that allows the user to program the operation of the shaker 10. In FIG. 1, an Erlenmeyer flask 18 is held within a flask clamp 20 which is constructed in accordance with a first exemplary embodiment of the invention 20. The Erlenmeyer flask 18 includes a bottom surface (not shown) which is generally circular in shape, a tapered portion 18T which is generally cone shaped, and a hip region 18H that spans between the bottom of the flask and the tapered portion 18T as is well known in the art. The flask can come in a variety of sizes, for example 25 ml, 50 ml, 125 ml, 250 ml, 500 ml, 1 liter, 2 liter and are commonly used in laboratories. A flask clamp 20 constructed in accordance with the invention can be constructed in different sizes to accommodate each of these different flask sizes or other sizes.

Figure 2:
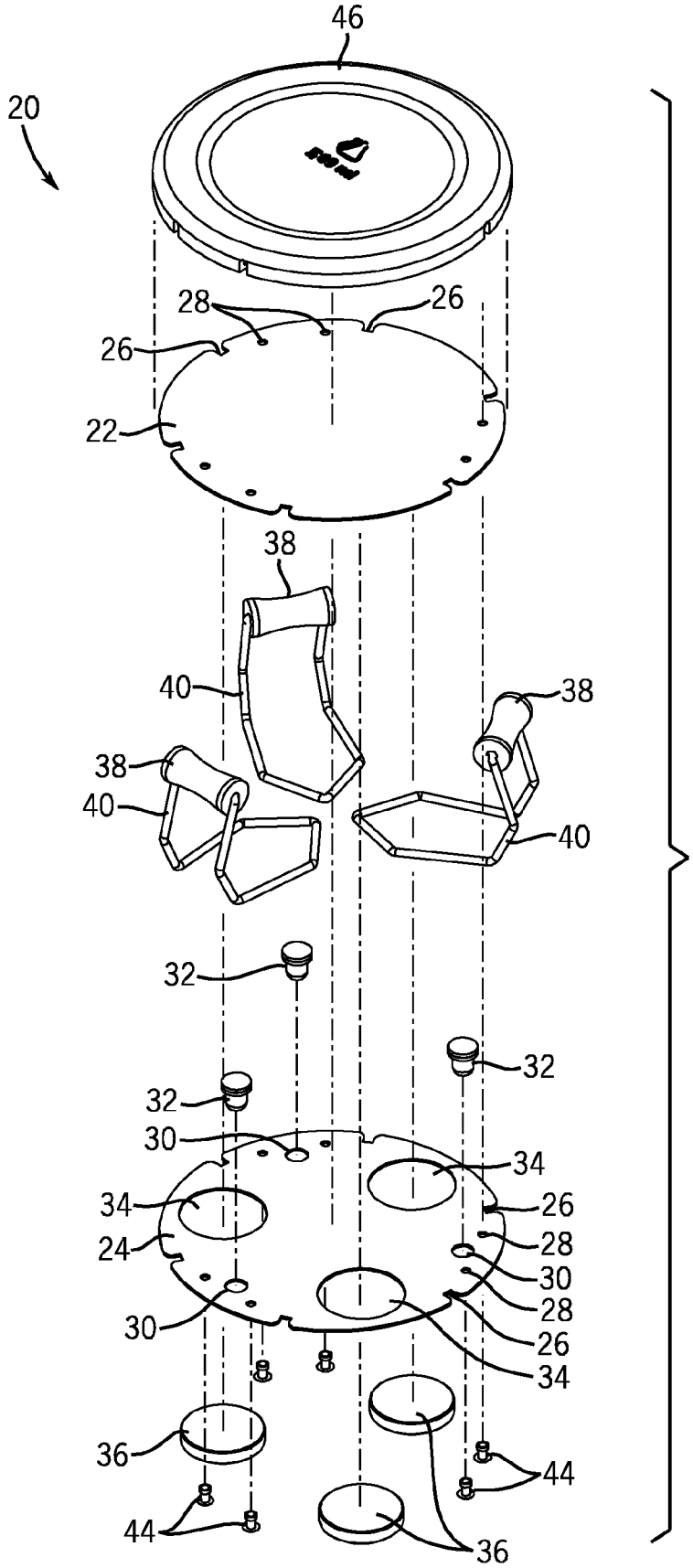
FIG. 2 is an assembly drawing of the flask clamp constructed in accordance with the first embodiment of the invention illustrated in FIG. 1.
Figure 3:
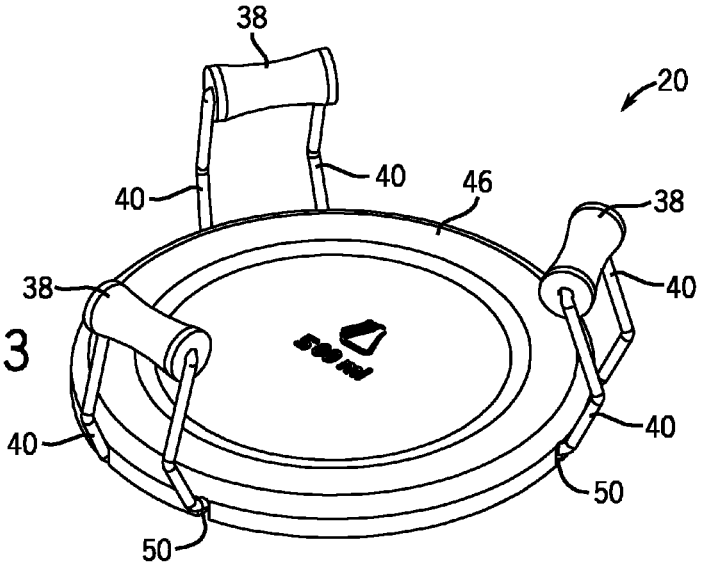
FIG. 3 is a top perspective view of the flask clamp constructed in accordance with the first embodiment of the invention.
Figure 4:
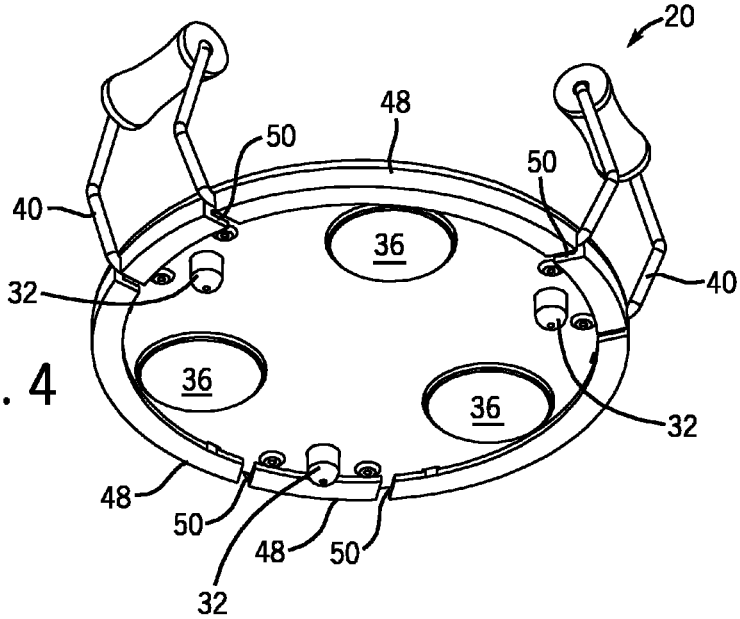
FIG. 4 is a bottom perspective view of the flask clamp constructed in accordance with the first embodiment of the invention.

Referring now to FIGS. 2-4, the flask clamp 20 in the first embodiment of the invention has a top base plate 22 and a bottom base plate 24. The top base plate 22 is preferably made of magnetic stainless steel so that permanent magnets are attracted to plate 22. It is desirable that both base plates 22, 24 remain rigid, flat and even during construction and in use. The exemplary flask clamp 20 is a 500 ml flask clamp, and for this size of flask clamp a plate thickness of 0.038" has been found to be suitable for the base plates 22 and 24. The top base plate 22 is generally circular in shape, but contains three pairs of notches 26 around its peripheral edge. The top base plate 22 also includes rivet holes 28. The bottom base plate 24 is generally the same size as the top base plate 22. Like the top base plate 22, the bottom base plate 24 includes rivet holes 28. As shown in FIG. 2, the bottom base plate 24 also includes notches 26 as shown in the top base plate 22. The bottom base plate 24 includes three circular openings 30 for positioning bosses 32 and three larger circular openings 34 for permanent magnets 36. The bottom plate 24 firmly holds the spring wire forms between the sheet metal plates which is important for reliable and predictable spring rates.

The flask clamp 20 also includes three contoured plastic rollers 38 which are attached to bent wire forms 40 forming resilient spring fingers. The wire forms are preferably made of spring stainless steel having an appropriate strength for the given size of the flask clamp. It has been found that constructing the spring fingers from wire forms is suitable for flasks sized 500 ml or less. The bent wire forms 40 and the contoured plastic rollers 38 are preferably spot welded to the bottom of the top base plate 22. The shape of the contoured plastic rollers 38 is chosen to correspond to the radius of the Erlenmeyer flask for which the clamp 20 is designed to hold.

The flask clamp 20 includes three (3) downwardly extending positioning bosses 32, preferably made of engineered thermal plastic such as polyoxymethylene. The downwardly extending bosses are sized and configured to fit into clamp positioning holes 52 on the shaker platform 12. Those skilled in the art will appreciate that positioning indentations in the shaker platform can be substituted for the positioning holes. Note that the distance between the positioning bosses 32 may vary depending on the size of the clamp 20, but in any event the distance is selected so that the clamp positioning bosses 32 will fit into clamp positioning holes 52 in the platform. The positioning bosses 32 include a shoulder 42, see FIG. 5, which preferably has a thickness corresponding generally to the diameter of the wire 40. The rivet holes 28 in the top base plate 22 and in the lower base plate 24 are preferably located between the location of the wire 40 and the location of the respective positioning boss 32.

Figure 5:
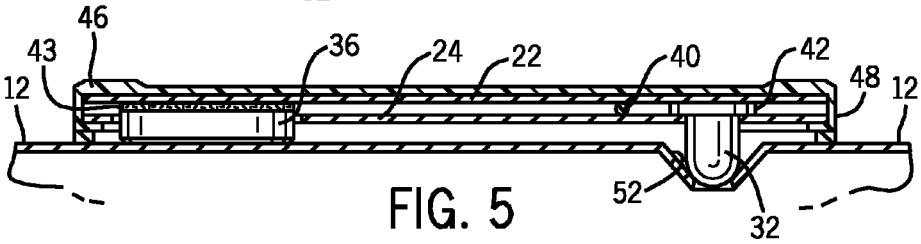
FIG. 5 is a sectional view taken along line 5-5 in FIG. 1.
Figure 6:
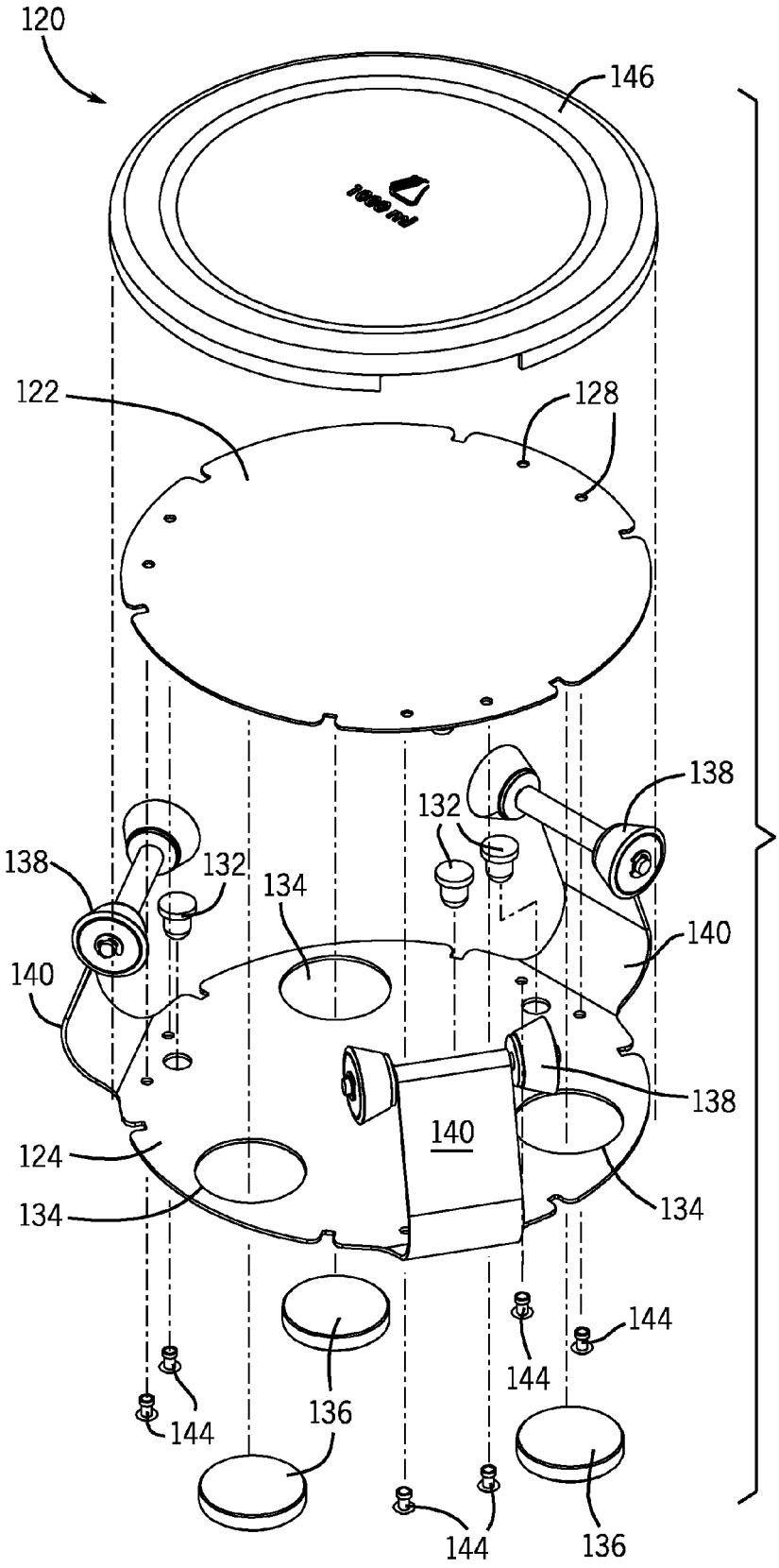
FIG. 6 is an assembly drawing of a flask clamp constructed in accordance with an exemplary second embodiment of the invention.

The magnets 36 are preferably round, flat rare earth magnets which have been nickel coated. It is desirable that the magnets remain magnetized if the flask clamp 20 is submerged in boiling water, or if the flask clamp 20 is treated in an autoclave. Most autoclaves operate at about 135° C. It has been found desirable to use magnets 36 that do not lose significant strength (maintain at least 50% of their strength) when exposed to temperatures at or below 150° C. The magnets 36 are attracted to the top base plate 22; however, it is desirable to attach the magnets 36 to the bottom of the top base plate 22 with adhesive. The nickel coating improves adhesion of the magnets to the top base plate 22, reduces oxidation of the magnetic material and wear of the magnet. FIG. 5 illustrates the magnet 36 being attached to the top base plate 22 with adhesive 43. Using pop rivets 44, the top plate 22 (with the wire forms 40 and the magnets 36 attached) is secured to the bottom base plate 24 with the positioning bosses 32 inserted through holes 30 in the bottom base plate 24. When the clamp 20 is fully constructed, the magnets 36 preferably extend below the bottom base plate 24 (see FIG. 5), e.g. for about 100 mil. It is desirable that there be slight clearance between the bottom of the magnets 36 and the shaker platform 12 although the scale of FIG. 5 does not enable this feature to be shown. The reason for the clearance is to assure that the flask clamp rests on the periphery of the cover lip 48. Also, as mentioned above, while the platform is shown in FIG. 5 as including positioning holes 52, indentations in the platform can be substituted for the holes.

Locating the magnets 36 near the periphery of the clamp base, as mentioned, focuses the magnetic attraction force near the periphery of the clamp base and thus improves stability of the clamp on the platform 12. The use of multiple magnets also enables the magnets to be adhered to the base plate 22 with alternating polarity direction if desired. In some instances, alternating polarity has been found to improve overall magnetic field strength. Since the top base plate 22 is made of a magnetic stainless steel, the top base plate tends to isolate the magnetic field from the flask on the clamp, and also refocuses the magnetic field towards the platform 12. In fact, it has been found that the magnetic attraction due to the magnetic field in the top base plate 22 improves overall stability of the clamp 20 when it is on the platform 12.

The flask clamp 20 also preferably includes a removable and replaceable soft cover 46. The soft cover 46 is preferably made of an elastomeric material such as injection molded EPDM or silicone. The soft cover 46 provides a frictional surface on the base of the clamp 20 for the bottom surface of the flask. In reference to FIG. 1, the rollers 38 provide normal forces against the tapered wall portion 18T of the Erlenmeyer flask when the flask 18 is held in the clamp 20. The net of these normal forces includes a downward component which helps to press the bottom surface of the flask 18 against the frictional surface provided by the removable soft cover 46, thereby preventing the flask 18 from rotating during operation of the shaker and providing quieter operation.

The cover 46 is preferably wide enough to wrap entirely around the base of the clamp 20. As shown in the drawings, the soft cover 46 includes a circumferential lip 48. The lip 48 includes slots 50 to accommodate the wire forms 40. As shown best in FIG. 5, the lip 48 seals against the shaker platform 12 when the magnetic pressure of the magnets 36 holds the clamp 20 against the shaker platform 12. The lip 48 on the soft cover 46 also helps to stabilize the clamp 20 on the platform 12. For larger flask it may be important to incorporate ribs to keep the lip 48 in place. Stabilizing feet as described in connection with the later embodiment can also be used if desirable. Another advantage of the cover 46 is that it helps to thermally insulate the flask from the clamp and the shaker.

One skilled in the art will recognize that locating the positioning bosses 32 in the positioning holes 52 or indentations in the shaker platform, while the magnets 36 provide downward magnetic pressure between the clamp 20 and the platform 12, prevents the flask clamp 20 from sliding horizontally along the shaker platform 12 when the shaker is in use. However, when the shaker is stopped, a user can easily remove the clamp 20 from the shaker platform 12 to either reposition the clamp 20 or to replace it with a clamp of a different size. It is not necessary for the user to remove the entire platform 12 from the shaker 10 in order to clean or autoclave the flask clamps 20, or to change clamp sizes. With respect particularly to FIG. 3, it should be apparent to those skilled in the art that a plurality of flask clamps 20 having the configuration shown in the figures can be easily nested and stacked for convenient and efficient storage.

FIGS. 6 through 9 illustrate a flask clamp constructed in accordance with a second embodiment of the invention. In many respects, the flask clamp 120 as illustrated in FIGS. 6-9 is similar to the flask clamp 20 described in FIGS. 2-5. The flask clamp 120 shown in FIGS. 6-9, however, is designed to accommodate larger flasks, such as a flask having a volume of 1000 ml. The flask clamp 120 includes spring fingers 140 and roller sets 138 designed to accommodate larger sized flasks than the bent wire form configuration illustrated in connection with the flask clamp 20 shown in FIGS. 2-5.

Figure 7:
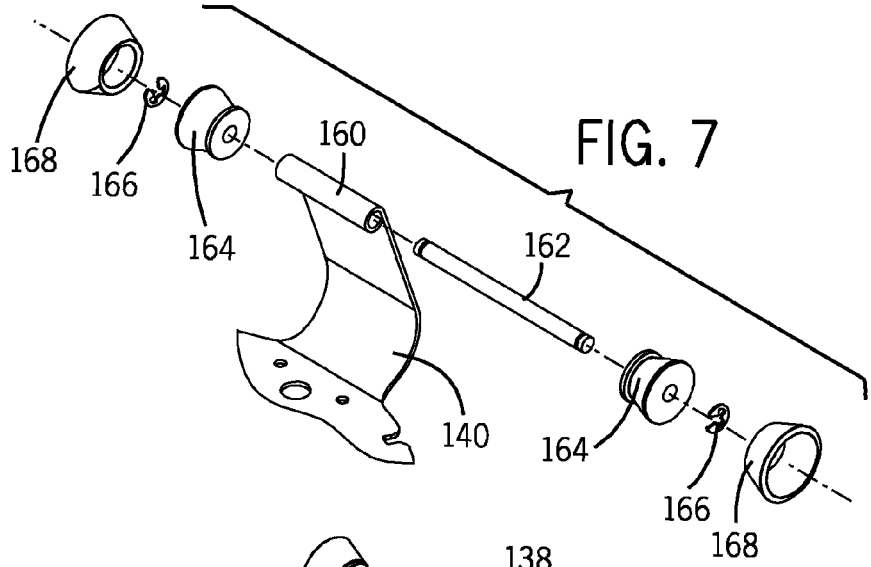
FIG. 7 is a detailed assembly view of a roller set assembly constructed in accordance with the second embodiment of the invention.
Figure 8:
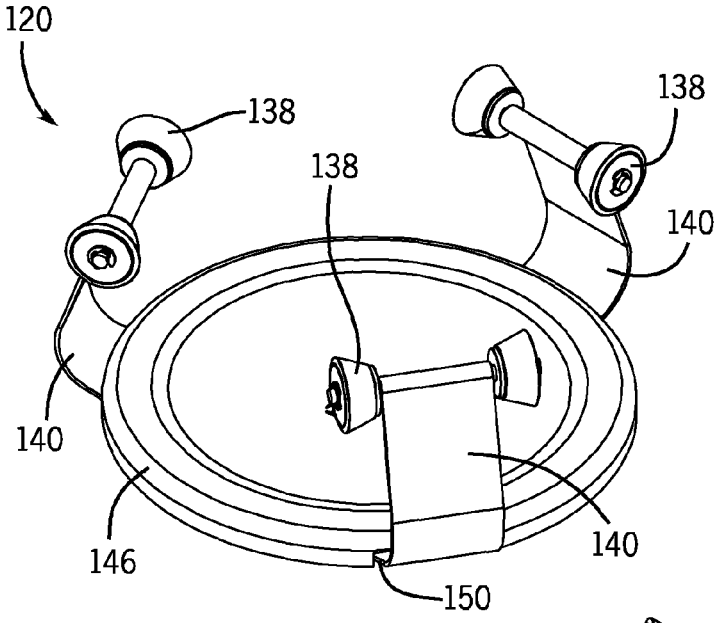
FIG. 8 is a top perspective view of the flask clamp constructed in accordance with the second embodiment of the invention.
Figure 9:
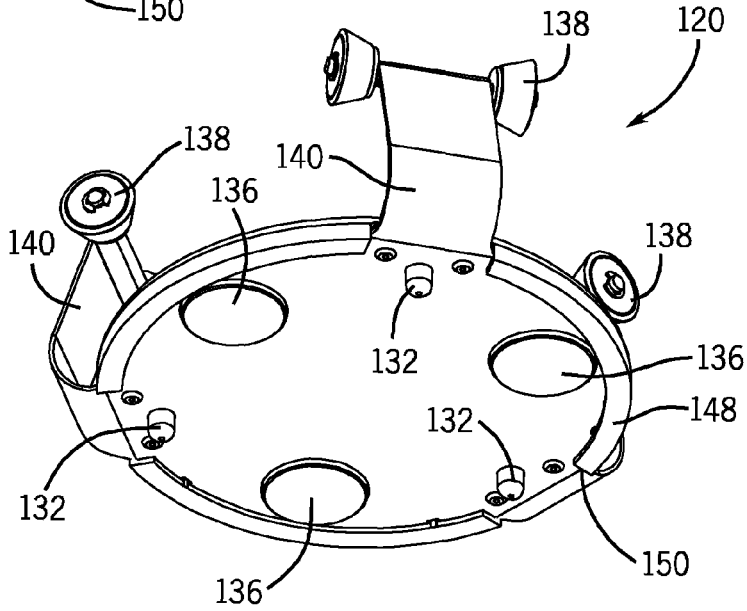
FIG. 9 is a bottom perspective view of the flask clamp constructed in accordance with the second embodiment of the invention.
Figure 10:
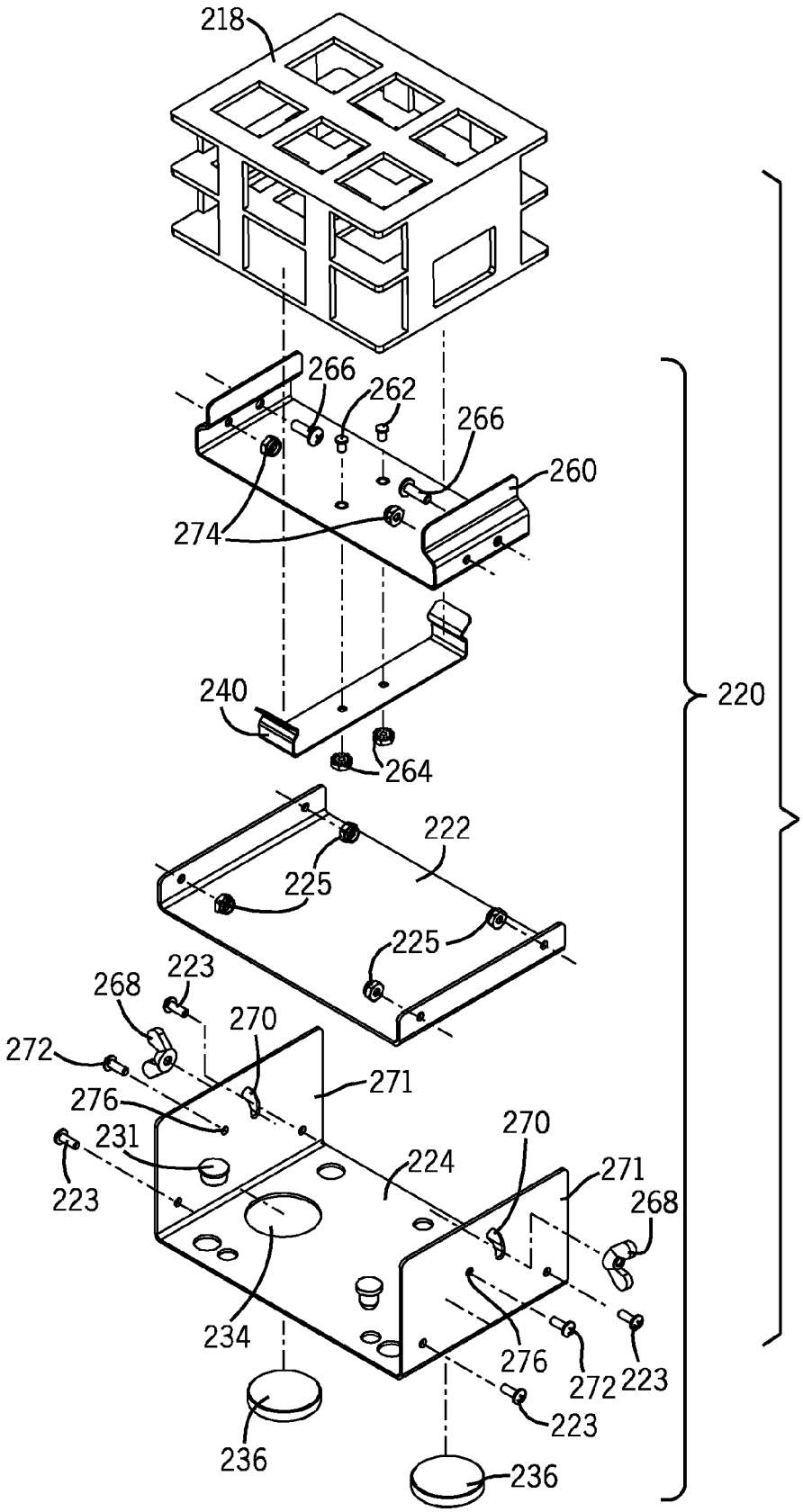
FIG. 10 is an assembly drawing of a test tube rack holder clamp constructed in accordance with an exemplary third embodiment of the invention.

The flask clamp 120 in FIGS. 6-9 includes a top base plate 122 made of a magnetic stainless steel, and a bottom base plate 124 made of non-magnetized spring stainless steel. The bottom base plate 124 includes openings 134 for the magnets 136 as in the other embodiment as well as openings for the positioning bosses 132. In the flask clamp 120 shown in FIGS. 6-9, the spring fingers 140 are made of spring stainless steel and are constructed integrally with the bottom base plate 124. This integral construction provides significant strength advantages especially for larger sized flasks. Referring in particular to FIG. 7, the top of each spring steel finger 140 is formed into a rolled axel sleeve 160. A roller axel 162 is captured within the sleeve 160 and rollers 164 are attached to the axel 162 using E-clips 166. Silicon sleeves or covers 168 are preferably stretched and fitted over the rollers 164. The rollers 164 are configured to contact the Erlenmeyer flask and to provide clearance between the spring fingers 140 and rolled axel sleeve 160.

Referring again to FIG. 6, the magnets 136 are preferably adhered to the top magnetic base plate 122 with adhesive. Then, with the positioning bosses 132 in place, the top base plate 122 is riveted together with the bottom base plate 124 using rivets 144. Although not the preferred embodiment, the magnets 136 can be constructed to have a stepped peripheral edge and the magnets 136 can be attached to the base by mechanically capturing the step shoulder between the top base plate 122 and the bottom base plate 124 with or without using adhesive.

As in the earlier embodiment, the base plate includes a soft elastomeric cover 146. The cover 146 includes a slot 150 to accommodate the spring fingers 140 extending upward from the lower base plate 124. The combination of the roller sets 138 with the soft elastomeric sleeves 168 and the soft elastomeric cover 146 on the base has been found to be particularly effective in eliminating spinning of even large volume flasks during shaker operation. At the same time, the forces required to insert and remove flasks from the clamp 120 are significantly less than with metal clamps typically used in the art, and the clamp 120 is significantly quieter than the metal clamps typically used in the art.

Figure 11:
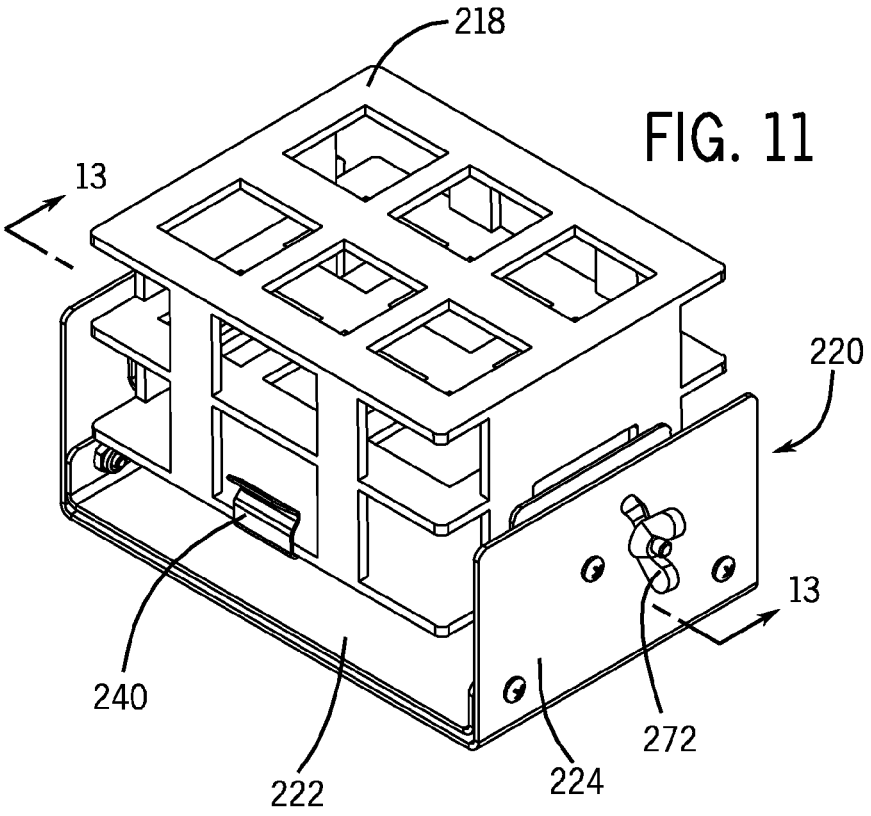
FIG. 11 is a top perspective view of the test tube rack holder clamp constructed in accordance with the third embodiment of the invention.
Figure 12:
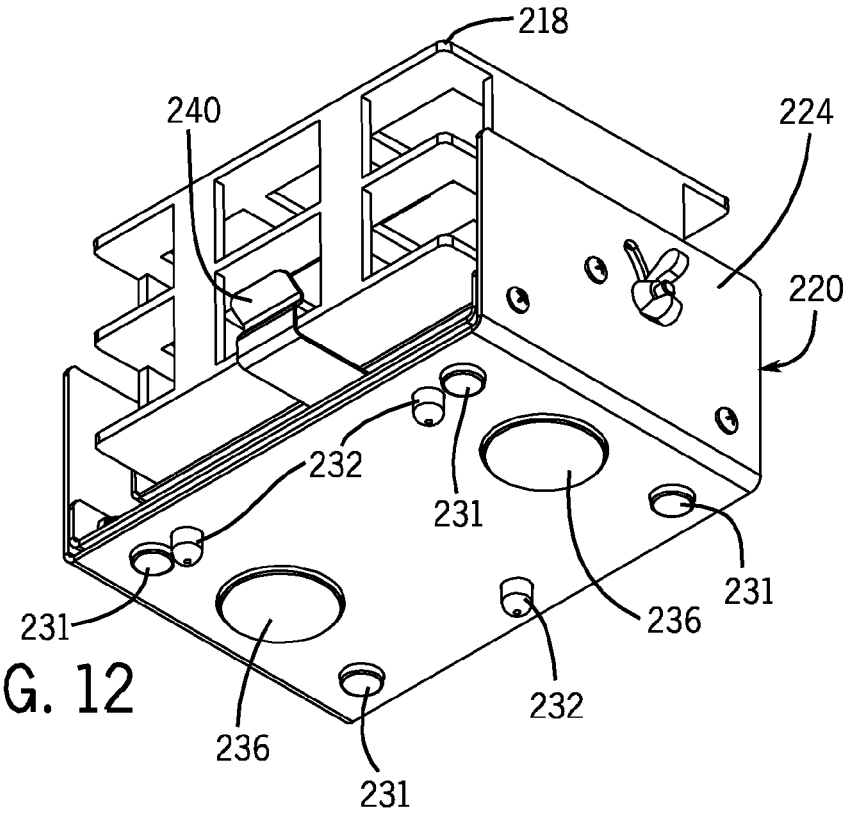
FIG. 12 is a bottom perspective view of the test tube rack holder clamp constructed in accordance with the third embodiment of the invention.
Figure 13:
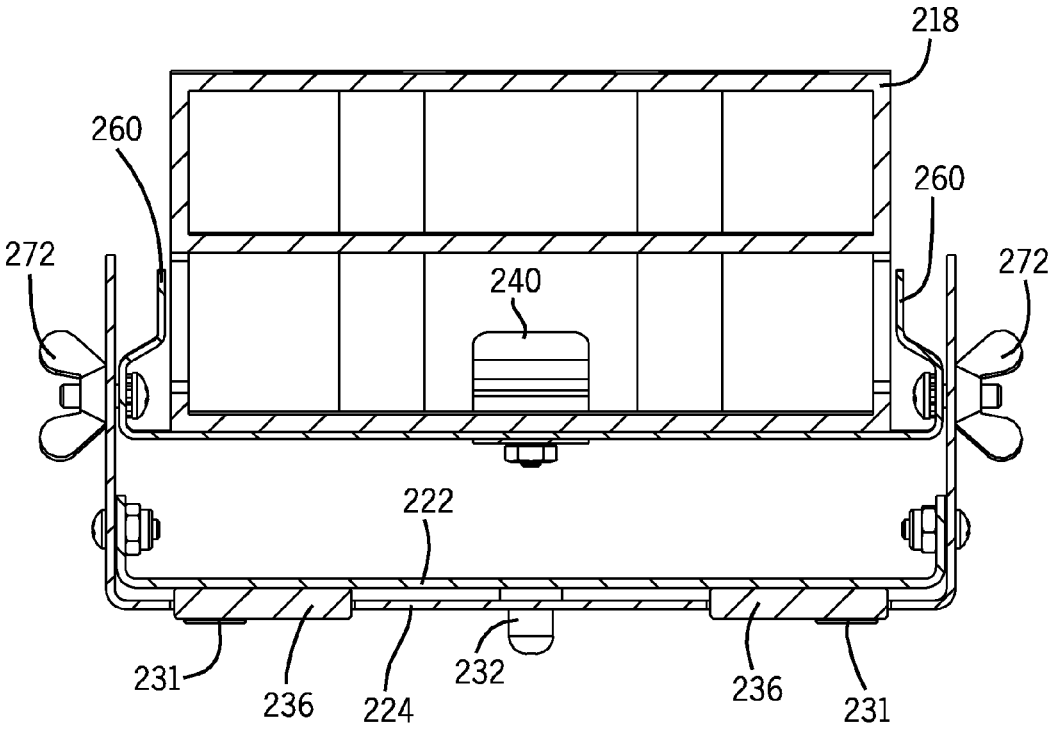
FIG. 13 is a sectional view of the test tube rack clamp along line 13-13 in FIG. 11.

FIGS. 10-13 illustrate a third embodiment of the invention in which the clamp 220 is configured to hold a test tube rack 218. The clamp 220 has a substantially rectangular bottom base plate 224 made of a non-magnetic material such as non-magnetic steel. The bottom base plate 224 includes holes 234 for the magnets 236. It also includes holes for the positioning bosses 232 and for stabilizing feet 231. Integral with the bottom base plate 224 are upstanding walls 271 which include openings for mounting the other components of the clamp 220 for holding the test tube rack 218. A top base plate 222 is made of a magnetic steel material. As in the other embodiments, the magnets 236 pass through the openings 234 in the bottom base plate 224 and are attached, e.g. by adhesive or otherwise, to the top base plate 222. The top base plate 222 is attached to the bottom base plate 224 once the positioning bosses 232 and the stabilizing feet 231 are in place via screws 223 and nuts 225. A resilient finger member 240 is attached to the test tube holder 260 via screws 262 and nuts 264. The test tube rack holder 260 is mounted to the upstanding walls 271 on the lower base plate member 224 in a manner known in the art to allow for tilting of the test tube rack 218. More specifically, the screws 272 pass through openings 276 in the upstanding walls 271 to attach the holder 260 via nuts 274 about a fixed pivot axis. Bolts 266 connect the rack holder 260 through elongated slot 270 in the upstanding walls 271 via wing nuts 268. The test tube rack 218 is placed in the clamp 220 as illustrated in FIGS. 11, 12 and 13. Referring in particular to FIG. 13, the stabilizing feet 231 extend slightly below the lower surface of the magnets 236 thereby providing slight clearance between the magnets and the shaker platform.

Figure 14:
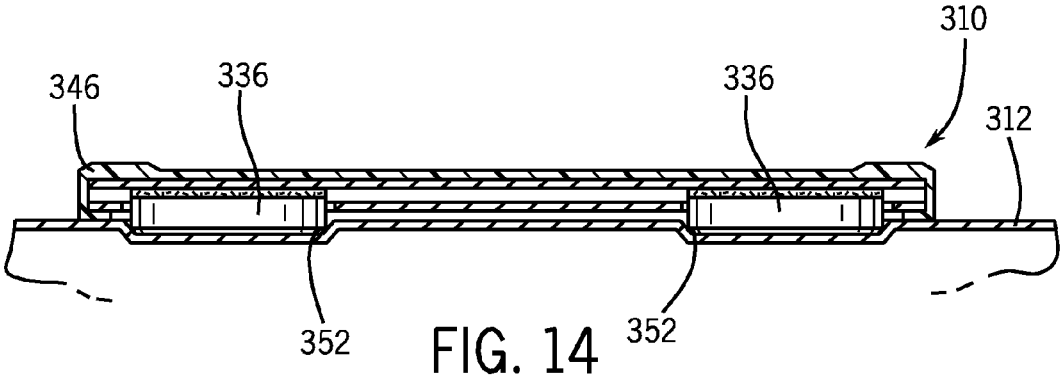
FIG. 14 is a view similar to FIG. 5 describing an alternative embodiment in which the permanent magnets extend downward from the base clamp into indentations on the shaker platform.

FIG. 14 illustrates an alternative base for a clamp 310 in which the permanent magnets 336 extend downward from the base of the clamp 310 and serve the dual function of being a positioning boss as well. In this embodiment of the invention, the shaker platform 312 includes indentations or embossments for the magnets 336, and not holes, as is suitable when using non-magnetic positioning bosses as described in the earlier embodiments. Note that the magnets 336 in FIG. 14 extend downward further than in the earlier embodiments so that the magnets 336 are captured within the indentations 352 to prevent sliding of the clamp.

While the drawings illustrate exemplary embodiments of the invention, the various aspects of the invention can be implemented independently of the other features of the invention. While the invention has been shown in connection with clamps for Erlenmeyer flasks and test tube holders, various aspects of the invention can be used in connection with other types of laboratory containers such as round bottom flasks, etc. In addition, some of the features of the invention can be implemented differently than demonstrated by the exemplary embodiment. For example, in one embodiment of the invention (not shown in the drawings), the permanent magnets are placed below the shaker platform 12, thereby eliminating the need for the permanent magnets 36 to be located on the base of the flask holder 20. In another embodiment, the positioning holes 52 on the platform 12 and the positioning bosses 32 on the clamp 20 can be replaced with indentations in the platform corresponding to the dimensions of the flask clamp base. In a somewhat similar vein, it is also possible to construct the shaker platform with upwardly extending positioning bosses and construct the clamp base with receptacles for the upwardly extending bosses in order to prevent the clamp from sliding. These and other changes and modifications may be made without departing from the spirit of the invention or from the scope of the appended claims.

What is claimed is:

1. A flask kit for use with a laboratory shaker, the flask camp kit comprising:

a shaker platform with an array of clamp positioning holes or indentations;

a clamp base;

one or more magnets attached to the clamp base and extending downward from the base;

at least one positioning bosses extending downward from the base, said at least one positioning bosses being configured to fit into clamp positioning holes or indentations on the shaker platform when the flask clamp is positioned on the shaker platform with the one or more magnets being magnetically attracted to the platform in order to magnetically secure the flask clamp on the shaker platform; and a flask holding mechanism attached to the clamp base.

2. A flask clamp kit as recited in claim 1 wherein the one or more permanent magnets are nickel coated magnets.

3. A flask clamp kit as recited in claim 1 wherein the one or more permanent magnets are rare earth magnets.

4. A flask clamp kit as recited in claim 1 wherein the clamp base comprises a plate made of magnetic, non-magnetized material to which the one or more permanent magnets are attached.

5. A flask clamp kit as recited in claim 1 wherein the one or more magnets attached to the clamp base and extending downward from the base comprises at least three permanent magnets equally spaced and located near the periphery of the clamp base.

6. A flask clamp kit as recited in claim 5 wherein the one or more permanent magnets continue to produce a sufficiently strong magnetic field even after the flask clamp is autoclaved at up to 135° C.

7. A flask clamp kit as recited in claim 5 wherein the one or more permanent magnets continue to produce a sufficiently strong magnetic field even after heated up to 150° C.

8. A flask clamp kit as recited in claim 1 wherein the clamp base further comprises a soft elastomeric cover.

9. A flask clamp kit as recited in claim 8 wherein the soft elastomeric cover wraps around the clamp base and provides a seal against the shaker platform when the flask clamp is magnetically secured to the shaker platform.

10. A flask clamp kit recited in claim 1 wherein the flask holding mechanism comprises:

three equally spaced spring fingers connected to the base and extending generally upward from the base; and a roller mechanism mounted on top of each spring linger.

11. A flask clamp kit as recited in 10 wherein the roller mechanisms comprise contoured plastic rollers.

12. A flask clamp kit as recited in claim 11 wherein the roller mechanisms further include elastomeric roller covers.

13. A flask clamp kit as recited in claim 1 wherein the clamp base comprises a top generally circular stainless steel plate to which the one or more permanent magnets are attached and a bottom generally circular plate which comprises holes through which the permanent magnets pass and are exposed below the clamp base.

14. A flask clamp kit as recited in claim 1 wherein: the peripheral edge of the magnets include stepped shoulders; the flask base comprises a top generally circular stainless steel plate and a bottom generally circular stainless steel plate having holes through which the permanent magnets pass and are exposed below the clamp base: and the magnets are attached to the clamp base at least in part by mechanically capturing the stepped shoulders oldie magnets between the top and bottom generally circular plates.

15. A flask clamp kit as recited in claim 5 wherein the permanent magnets are flat, round magnets.

16. A clamp kit for securing one or more containers on a laboratory shaker, said kit comprising:

a shaker platform with an array of clamp positioning holes or indentations;

a clamp base;

one or more permanent magnets attached to the clamp base and extending downward from the base; and at least one positioning bosses extending downward from the base, said at least one positioning bosses being configured to fit into clamp positioning holes or indentations on the shaker platform when the clamp is positioned on the shaker platform with one or more magnets being magnetically attracted to the platform in order to magnetically secure the clamp on the shaker platform.

17. A clamp kit as recited in claim 16 further comprising a flask holding mechanism attached to the clamp base, the holding mechanism having more than one inwardly spring biased rollers located above the clamp base for engaging a sidewall of a flask placed in the clamp with opposing holding pressure.

18. A clamp kit as recited in claim 16 further comprising a test tube rack holder attached to the clamp base.

19. A clamp kit as recited in claim 16 wherein the clamp base comprises a plate made of magnetic, non-magnetized material to which the one or more permanent magnets are attached.

20. A clamp kit as recited in claim 16 wherein the one or more permanent magnets are nickel coated magnets.

21. A clamp kit as recited in claim 16 wherein the one or more permanent magnets are rare earth magnets.

22. A clamp kit as recited in claim 16 wherein the one or more permanent magnets continue to produce a magnetic held even after the clamp is autoclaved at 135° C.

23. A clamp kit as recited in claim 16 wherein the one or more permanent magnets continue to produce a sufficiently strong magnetic field even after being heated up to 150° C.

24. A clamp kit as recited in claim 16 wherein the clamp base comprises a top plate to which the one or more permanent magnets are attached and a bottom plate which comprises holes through which the permanent magnets pass and are exposed below the clamp base.

25. An apparatus comprising: a laboratory shaker an Erlenmeyer flask having a bottom, a tapered section and a hip region that spans between the bottom and the tapered section, said tapered section being located above a hip line of the Erlenmeyer flask; and a flask clamp for the Erlenmeyer flask comprising:

a base;

a flask holding mechanism attached to the base, the holding mechanism having three equally spaced resilient spring lingers connected to the base and extending generally upward from the base and a roller mechanism mounted on top of each spring finger, the roller mechanisms being inwardly biased by the spring fingers and located above the hip line for the Erlenmeyer flask when it is placed in the flask clamp, said roller mechanisms providing a net force with a downward component; and a frictional surface on the flask clamp base which engages the bottom of said Erlenmeyer flask when it is located in the flask clamp, wherein the friction force of the frictional surface on the base against the bottom of the Erlenmeyer flask prevents the flask from spinning when the shaker is in operation.

26. A apparatus as recited in claim 25 wherein the frictional surface is on a removable elastomeric cover for the base.

27. An apparatus as recited in claim 25 wherein the roller mechanisms include elastomeric roller covers.

* * * * *